US006328047B1

(12) United States Patent
Lee

(10) Patent No.: US 6,328,047 B1
(45) Date of Patent: Dec. 11, 2001

(54) POSITION ADJUSTMENT MEMBER OF A SUNSHADE

(76) Inventor: Chorng-Cheng Lee, No. 272, Lane 365, Wu Feng South Road, Chia Yi (TW)

( * ) Notice: Subject to any disclaimer, the term of this patent is extended or adjusted under 35 U.S.C. 154(b) by 0 days.

(21) Appl. No.: 09/619,269

(22) Filed: Jul. 19, 2000

(51) Int. Cl.[7] ..... A45B 17/00

(52) U.S. Cl. ..... 135/20.1; 135/15.1; 403/220; 403/291

(58) Field of Search ..... 135/15.1, 20.1, 135/25.1; 403/220, 291

(56) References Cited

U.S. PATENT DOCUMENTS 1,996,071 * 4/1935 Kahn .
4,582,078 * 4/1986 Ma .
5,135,189 * 8/1992 Ghazizadeh .
5,297,570 * 3/1994 Conner .
5,383,633 * 1/1995 Ellestad .
5,445,471 * 8/1995 Wexler et al. ..... 403/220
5,521,803 * 5/1996 Eckert et al. .
5,803,647 * 9/1998 Hughes ..... 403/291 X
5,871,024 * 2/1999 Vanderwinden ..... 135/20.1
5,896,880 * 4/1999 Bushweller et al. ..... 135/20.1 X
5,947,138 * 9/1999 De Angelis .
6,073,642 * 6/2000 Huang ..... 135/15.1 X
6,154,913 * 12/2000 Burton ..... 403/220 X

* cited by examiner

*Primary Examiner*—Robert W. Gibson, Jr.
(74) *Attorney, Agent, or Firm*—Rosenberg, Klein & Lee

(57) ABSTRACT

A position adjustment member of a sunshade includes two connecting holders and an adjusting part. The connecting holders are connected to a lower end of an upper part of a shank and an upper end of lower part of a shank of the sunshade respectively. The connecting holders each has a nut fixed thereto. The adjusting part has a covering part, a metallic part and two bolts. The bolts are connected to two ends of the covering part. The covering part is made of plastic or rubber. The metallic part has plasticity and is received in the covering part. The bolts are screwed into a respective one of the nuts. The adjustment part is bent for the sunshade to be adjusted to an appropriate position relative to the sun.

3 Claims, 4 Drawing Sheets

POSITION ADJUSTMENT MEMBER OF A SUNSHADE

BACKGROUND OF THE INVENTION

The present invention relates to a position adjustment member of a sunshade, and particularly to one with which the sunshade can be steplessly adjusted in respect of the position, i.e. the sunshade can be adjusted to an appropriate position according to position of the sun at any time.

Sunshades with conventional position adjustment members have been devised. However, the conventional position adjustment members of sunshades can only adjust the sunshades to one of finite various positions. And, the conventional adjustment members can only move the shanks of the sunshade on a same plane; consequently, the sunshade has to be relocated on the ground after sun moves as time passes.

So, the conventional adjustment members of sunshades have disadvantages as follows.

1. They cannot always adjust the sunshade to the appropriate position relative to the sun.
2. The sunshade has to be removed and relocated after the sun moves because the conventional adjustment member can only move the shank on a same plane.

SUMMARY OF THE INVENTION

Therefore, it is a main object of the present invention to provide a position adjustment member for a sunshade which can adjust the sunshade to an appropriate position relative to the sun at any time.

The position adjustment member of a sunshade of the present invention includes:

two connecting holders; the connecting holder being connected to a lower part and an upper part of a shank of the sunshade respectively; the connecting holders each having a nut fitted thereto;

an adjustment part, including a covering part having plasticity;

a metallic part received in the covering part;

two bolts; the bolts projecting on two ends of the covering part, the bolts being screwed into a respective one of the nuts;

whereby the adjustment member can be bent in order for the sunshade to be adjusted to an appropriate position relative to the sun.

BRIEF DESCRIPTION OF THE DRAWINGS

The present invention will be better understood by reference to the accompanying drawings, wherein.

DESCRIPTION OF THE PREFERRED EMBODIMENT

Figure 1:
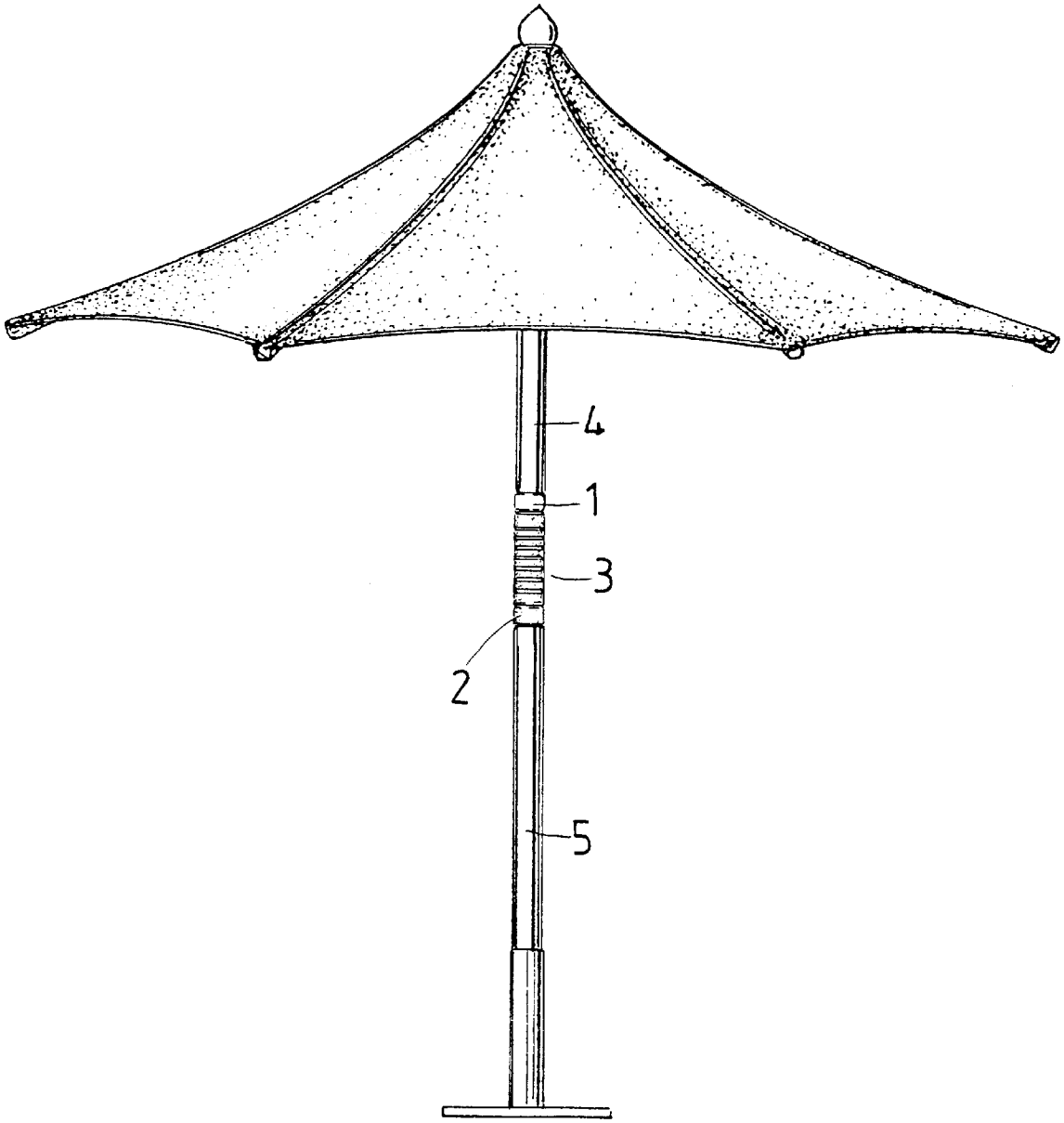
FIG. 1 is a view of the sunshade with the position adjustment member of the present invention.
Figure 2:
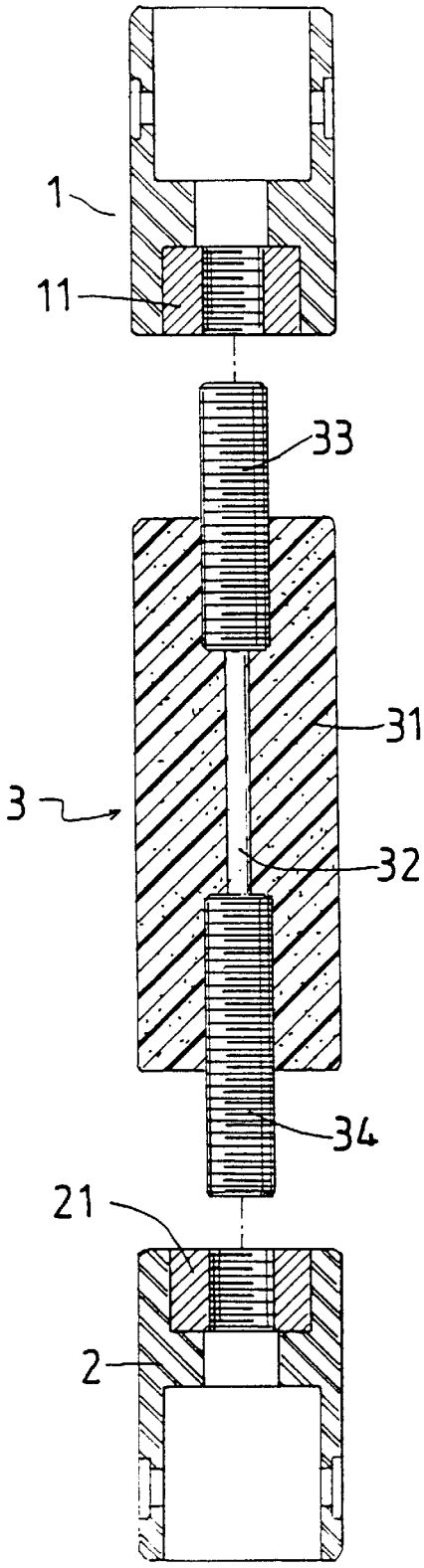
FIG. 2 is an exploded view of the adjustment member of the present invention.

Referring to FIGS. 1 and 2, a position adjustment member of a sunshade of the present invention includes connecting holders 1, 2 and an adjusting part 3.

The connecting holder 1 is connected to a lower end of an upper part 4 of the shank of the sunshade. The connecting holder 2 is connected to an upper end of a lower part 5 of the shank. The connecting holders 1, 2 each has a nut 11, 21 fitted thereto.

The adjusting part 3 has a covering part 31, a metallic part 32, blots 33, 34. The covering part 31 is plastic, and can be made of rubber or plastic. Referring specifically to FIG. 2, the covering part 31 is made of rubber having suitable hardness such that the position won't be changed by wind blowing the sunshade.

The metallic part 32 is inserted into the covering part 31; the metallic part 32 is soft, and has plasticity.

The bolts 33, 34 are fitted to the upper and the lower ends of the covering part 31 respectively; the bolts 33, 34 have outer ends projecting on the covering part 31.

Figure 3:
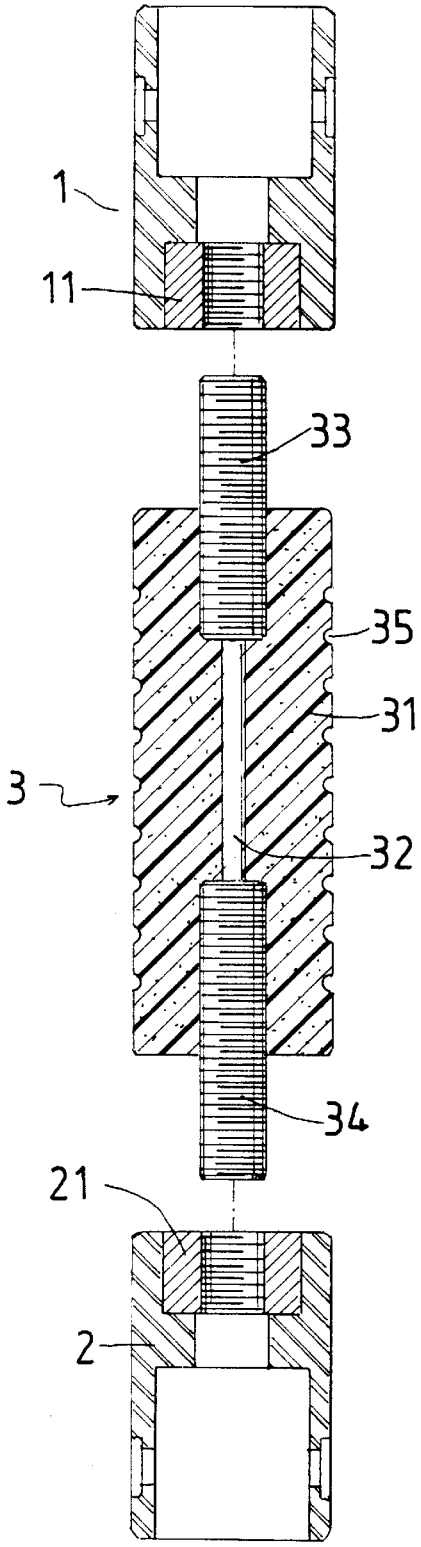
FIG. 3 is an exploded view of the adjustment member according to the second embodiment of the present invention.

Referring to FIG. 3, the covering part 31 is made of plastic; the covering part 31 is provided with annular recesses 35 thereon such that the covering part 31 can be bent easily, and can be broken when bent.

Figure 4:
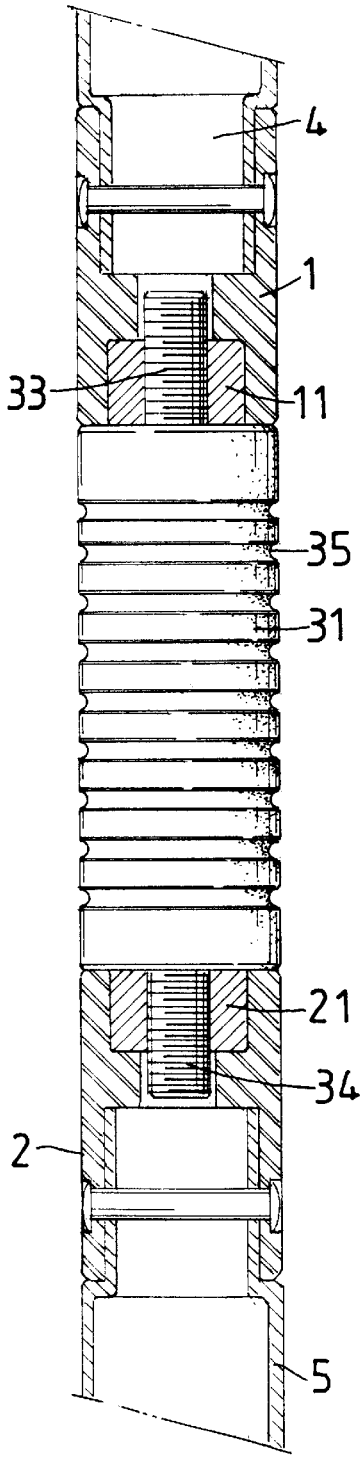
FIG. 4 is a view of the adjustment member in FIG. 3.

In combination, referring to FIG. 4, the bolts 33, 34 are screwed into the nuts 11, 21 respectively. Thus, the shank upper part and lower part 4, 5 are connected with the adjusting part 3.

Figure 5:
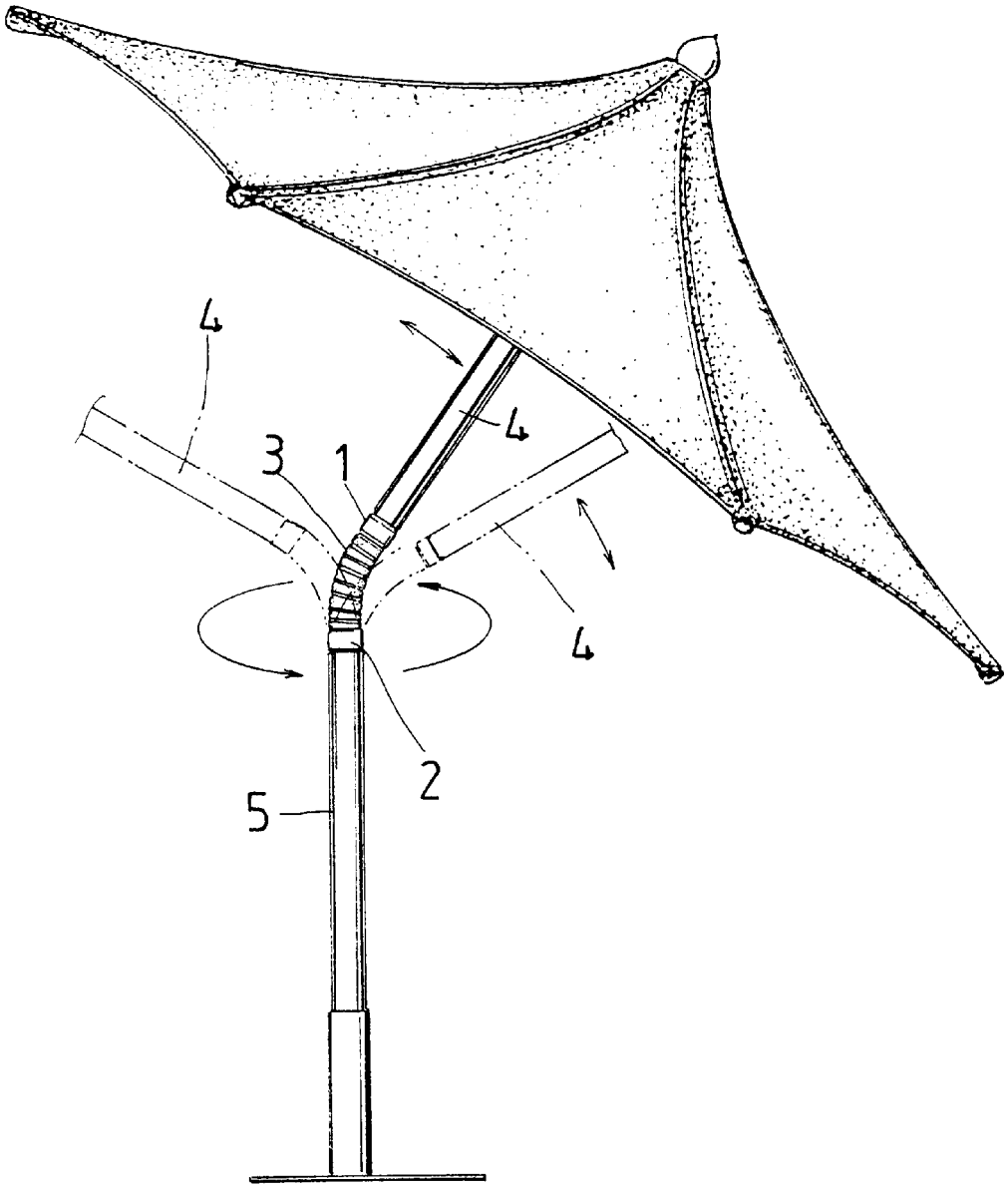
FIG. 5 is a view of the sunshade with the adjustment member in use.

In using the sunshade, referring to FIG. 5, the user can bend the adjusting part 3 to an appropriate position relative to the sun in order for the sunshade to form a best protection from the sun.

From the above description, the position adjustment member of a sunshade can be known to have desirable features as compared with the conventional one as follows.

1. The adjustment member can be bent to an appropriate position relative to the sun for the sunshade to form a best protection.
2. The adjustment member can be bent not only on a same plane so the sunshade don't have to be relocated after sun moves as time passes.

What is claimed is:

1. A position adjustment member of a sunshade, comprising two connecting holders, said connecting holders being connected to a lower end of an upper part of a shank of said sunshade and an upper end of a lower part of said shank respectively; said connecting holders each having a nut fitted thereto;

an adjusting part, including a covering part, said covering part having plasticity;

a metallic part, said metallic part being received in said covering part; said metallic part having plasticity;

two bolts, said bolts being connected to, and projecting on, a lower end and an upper end of said covering part respectively; said bolts being screwed into a respective one of said nuts;

whereby said adjustment member can be bent to locate said sunshade at an appropriate position relative to the sun.

2. The position adjustment member of a sunshade as claimed in claim 1, wherein said covering part is made of rubber.

3. The position adjustment member of a sunshade as claimed in claim 1, wherein said covering part is made of plastic, and has plurality of annular recesses thereon.

* * * * *